US010260384B2

(12) United States Patent
Mitsutani

(10) Patent No.: US 10,260,384 B2
(45) Date of Patent: Apr. 16, 2019

(54) VALVE TIMING REGULATION DEVICE

(71) Applicant: DENSO CORPORATION, Kariya, Aichi-pref. (JP)

(72) Inventor: Tetsuro Mitsutani, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/564,874

(22) PCT Filed: Apr. 6, 2016

(86) PCT No.: PCT/JP2016/001921

§ 371 (c)(1),
(2) Date: Oct. 6, 2017

(87) PCT Pub. No.: WO2016/163119

PCT Pub. Date: Oct. 13, 2016

(65) Prior Publication Data

US 2018/0112563 A1 Apr. 26, 2018

(30) Foreign Application Priority Data

Apr. 8, 2015 (JP) ..... 2015-79165

(51) Int. Cl.
*F01L 1/344* (2006.01)
*F01L 1/356* (2006.01)
*F01L 1/46* (2006.01)

(52) U.S. Cl.
CPC ..... *F01L 1/3442* (2013.01); *F01L 1/356* (2013.01); *F01L 1/46* (2013.01);
(Continued)

(58) Field of Classification Search
CPC ..... F01L 2001/3443; F01L 2001/34433; F01L 2001/3445; F01L 1/46
(Continued)

(56) References Cited

U.S. PATENT DOCUMENTS 7,389,756 B2 * 6/2008 Hoppe ..... F01L 1/34 123/90.15
8,910,602 B2 12/2014 Bohner et al.
(Continued)

FOREIGN PATENT DOCUMENTS

JP 2011-196245 10/2011

OTHER PUBLICATIONS

International Search Report for PCT/JP2016/001921, dated Jul. 12, 2016, 2 pages.
(Continued)

*Primary Examiner* — Jorge Leon, Jr.
(74) *Attorney, Agent, or Firm* — Nixon & Vanderhye P.C.

(57) ABSTRACT

A valve timing regulation device includes a housing, a vane rotor, a sleeve and a spool. The housing is fit to an end of a camshaft. The sleeve has a supply port, a drain port, a first control port, a second control port and a first drain oil passage. The spool has a connection oil passage provided to a shaft center part to connect the supply port to either the first control port or the second control port according to an own axial position. The drain port is connected to a drain space through a second drain oil passage provided to span the vane rotor and the camshaft. A hydraulic oil of a retard chamber is discharged to the drain space through the second drain oil passage. It is unnecessary to provide a discharge hole to the camshaft, and a shaft length of the camshaft can be shorter.

3 Claims, 6 Drawing Sheets

(52) U.S. Cl.
CPC ..... *F01L 2001/3443* (2013.01); *F01L 2001/3445* (2013.01); *F01L 2001/34423* (2013.01); *F01L 2001/34426* (2013.01); *F01L 2001/34433* (2013.01); *F01L 2001/34453* (2013.01)

(58) Field of Classification Search
USPC ..... 123/90.17
See application file for complete search history.

(56) References Cited

U.S. PATENT DOCUMENTS

| | | | | |
|---|---|---|---|---|
| 8,931,451 | B2 * | 1/2015 | Scheidig | F01L 1/34409 123/90.15 |
| 2015/0075460 | A1 | 3/2015 | Mitsutani | |
| 2016/0298505 | A1 | 10/2016 | Mitsutani | |

OTHER PUBLICATIONS

Written Opinion of the ISA for PCT/JP2016/001921, dated Jul. 12, 2016, 4 pages.

* cited by examiner

VALVE TIMING REGULATION DEVICE

CROSS REFERENCE TO RELATED APPLICATION

This application is the U.S. national phase of International Application No. PCT/JP2016/001921 filed Apr. 6, 2016, and claims priority to Japanese Patent Application No. 2015-79165 filed on Apr. 8, 2015, the disclosures of each of which are incorporated herein by reference.

TECHNICAL FIELD

The present disclosure relates to a valve timing regulation device.

BACKGROUND ART

A valve timing regulation device is provided to a power transmission path transmitting a power from a drive shaft to a driven shaft of an internal combustion engine, and regulates valve timing of an inlet valve and an exhaust valve driven to open and close by the driven shaft. A hydraulic valve timing regulation device includes a housing rotating in association with one of the drive shaft and the driven shaft, and a vane rotor fixed to an end of the other one of the drive shaft and the driven shaft. The vane rotor divides an interior of the housing into a first hydraulic chamber and a second hydraulic chamber. By supplying a hydraulic oil to one of the first hydraulic chamber and the second hydraulic chamber, the vane rotor is rotated relative to the housing in an advance direction or a retard direction. The hydraulic oil is supplied by an oil passage switching valve.

A valve timing regulation device disclosed in Patent Literature 1 has an oil passage switching valve which is a spool valve provided to a center part of the vane rotor. The oil passage switching valve includes a sleeve having various ports, and a spool moving axially in the sleeve.

The sleeve is formed in a cylindrical shape to extend axially and has a supply port, a first drain port, a first control port, a second control port, and a second drain port, which are provided sequentially from a camshaft side. The supply port communicates with a supply oil passage of the camshaft. The first drain port communicates with a drain oil passage which radially penetrates through the camshaft. The first control port communicates with the first hydraulic chamber. The second control port communicates with the second hydraulic chamber. The second drain port communicates with a drain space located outside on an opposite side to the camshaft with the vane rotor in between.

The spool has a connection oil passage provided to a shaft center part to connect the supply port to either the first control port or the second control port according to an own axial position.

When the hydraulic oil is supplied to the first hydraulic chamber, the oil passage switching valve connects the second control port to the second drain port while connecting the supply port to the first control port. In such a circumstance, the hydraulic oil in the second hydraulic chamber is discharged to the drain space from the second drain port. Meanwhile, when the hydraulic oil is supplied to the second hydraulic chamber, the oil passage switching valve connects the first control port to the first drain port while connecting the supply port to the second control port. Hydraulic oil in the first hydraulic chamber is discharged to an outside from a discharge hole opening in an outer peripheral surface of the camshaft.

PRIOR ART LITERATURES

Patent Literature

Patent Literature 1: U.S. Pat. No. 8,910,602B2

SUMMARY OF INVENTION

In the valve timing regulation device disclosed in Patent Literature 1, a circular clearance is provided between the camshaft and the housing in a portion where the camshaft is inserted. Hydraulic oil in the first hydraulic chamber is discharged to the outside through the circular clearance from the discharge hole opening in the outer peripheral surface of the camshaft.

However, in a case where the valve timing regulation device is configured in such a manner that the housing is fit to the camshaft and a housing fit portion of the camshaft rotatably supports the housing, the circular clearance cannot be provided between the housing fit portion of the camshaft and the housing. It thus becomes necessary to space the discharge hole from the housing fit portion axially in the camshaft. Hence, a shaft length of the camshaft may possibly be extended by a length of the discharge hole.

An object of the present disclosure is to provide a valve timing regulation device capable of making a shaft length of a shaft fixed with a vane rotor shorter even when a connection oil passage is provided to a shaft center part of a spool in an oil passage switching valve.

According to the present disclosure, the valve timing regulation device includes a housing, a vane rotor and a sleeve. The housing rotates in association with a first shaft which is one of a drive shaft and a driven shaft. The housing is fit to an end of a second shaft which is the other one of the drive shaft and the driven shaft, and is rotatably supported by the second shaft.

The vane rotor fixed to an end of the second shaft. The vane rotor has a vane dividing an internal space of the housing to a first hydraulic chamber on a first side in a circumferential direction and a second hydraulic chamber on a second side in the circumferential direction. The vane rotor rotates relative to the housing according to a pressure of a hydraulic oil supplied to the first hydraulic chamber and the second hydraulic chamber.

The sleeve provided to a center part of the vane rotor. The sleeve has a supply port, a drain port, a first control port, a second control port and a first drain oil passage which are provided sequentially from the second shaft. The supply port communicates with a supply oil passage of the second shaft. The drain port communicates with a drain space on an opposite side to the second shaft with the vane rotor in between. The first control port communicates with the first hydraulic chamber. The second control port communicates with the second hydraulic chamber. The first drain oil passage communicates with the drain space.

The spool axially moves in the sleeve. The spool has a connection oil passage provided to a shaft center part to connect the supply port to either the first control port or the second control port according to an own axial position. The spool connects the second control port to the first drain oil passage while connecting the supply port to the first control port when the hydraulic oil is supplied to the first hydraulic chamber. The spool connects the first control port to the drain port while connecting the supply port to the second control port when the hydraulic oil is supplied to the second hydraulic chamber.

The drain port is connected to the drain space through a second drain oil passage provided to the vane rotor or to span the vane rotor and the second shaft.

In the valve timing regulation device configured as above, the hydraulic oil in the second hydraulic chamber is discharged to the drain space through the second control port and the first drain oil passage located on the side of the drain space. Meanwhile, the hydraulic oil in the first hydraulic chamber is discharged to the drain space through the first control port, the drain port, and the second drain oil passage located on the side of the second shaft. In short, the hydraulic oil in either hydraulic chamber is discharged to the drain space on the opposite side to the second shaft with the vane rotor in between. Such a configuration eliminates a need to provide a discharge hole to the second shaft. Consequently, a shaft length of the second shaft can be shorter by omitting the discharge hole.

Hence, according to the present disclosure, even when the connection oil passage is provided to the shaft center part of the spool in the oil passage switching valve, a shaft length of the second shaft that is a shaft to which the vane rotor is fixed can be shorter.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
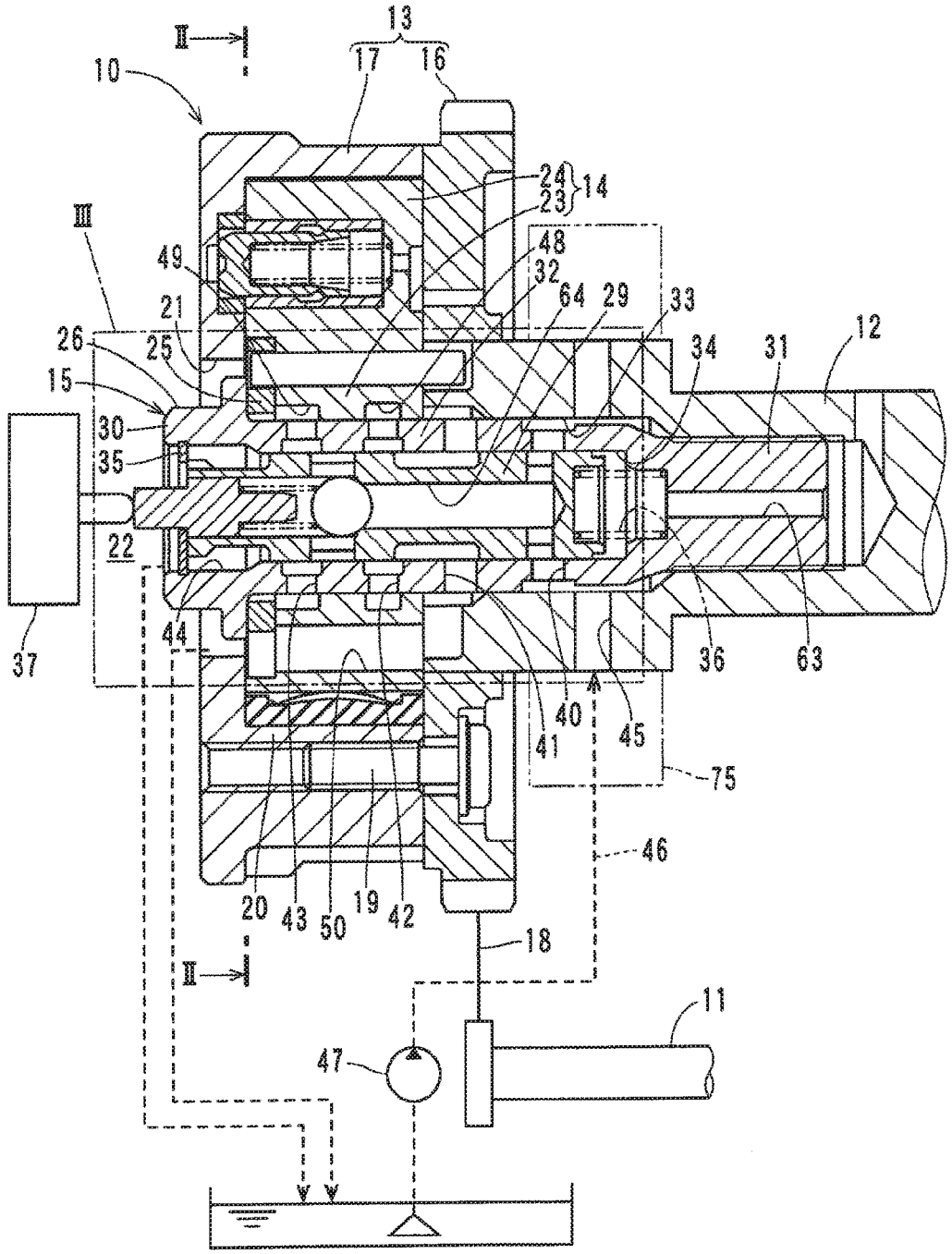
FIG. 1 is a sectional view of a valve timing regulation device according to a first embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted.

(First Embodiment)

FIG. 1 shows a valve timing regulation device according to a first embodiment of the present disclosure. A valve timing regulation device 10 regulates valve timing of an inlet valve that is not shown and is driven to open and close by a camshaft 12 by varying a rotational phase of the camshaft 12 with respect to a crankshaft 11 of an internal combustion engine. The valve timing regulation device 10 is provided to a power transmission path from the crankshaft 11 to the camshaft 12. The crankshaft 11 corresponds to a drive shaft and the camshaft 12 corresponds to a driven shaft.

Figure 2:
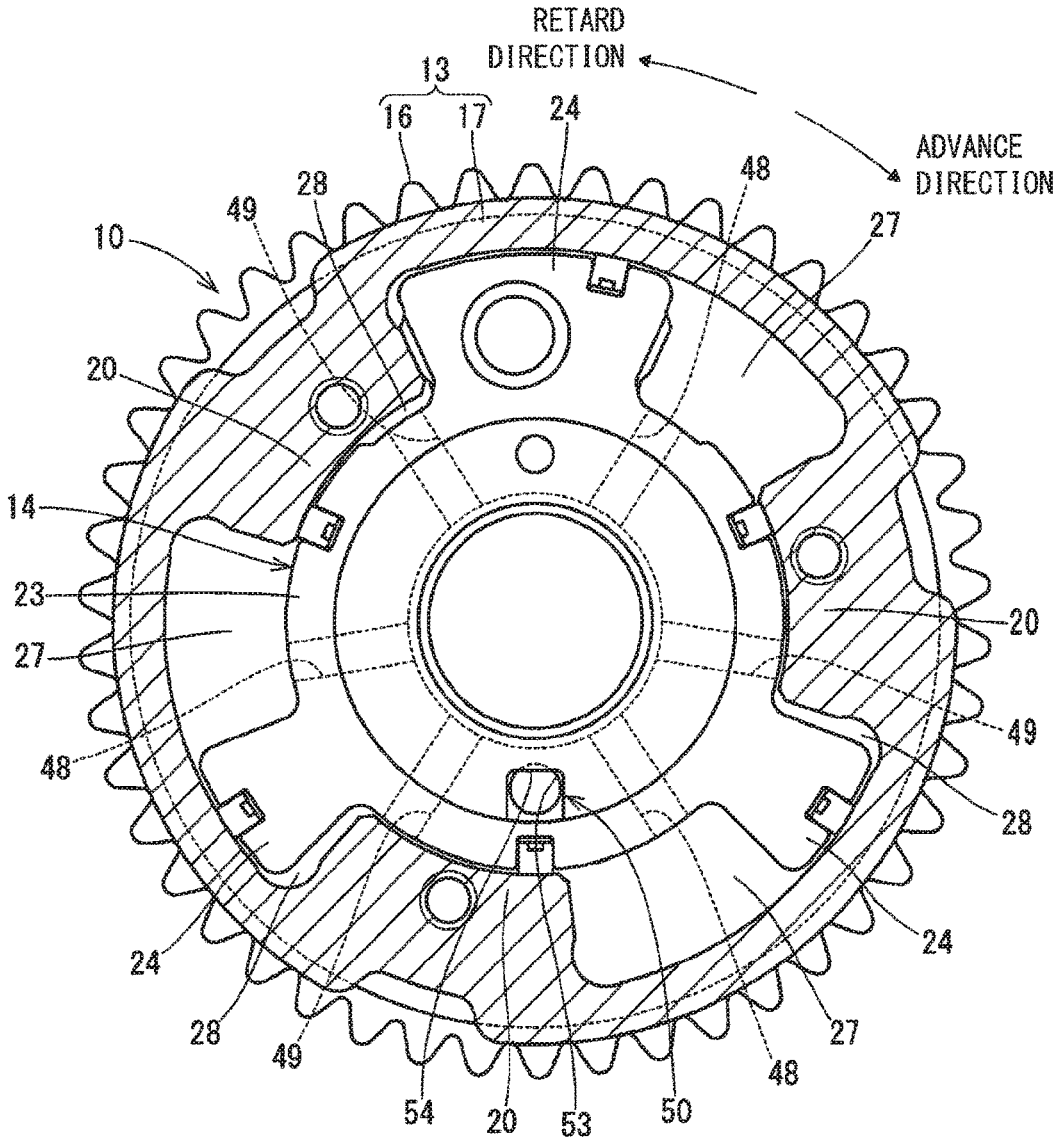
FIG. 2 is a sectional view taken along the line II-II of FIG. 1 to only show a housing and a vane rotor.

Firstly, a fundamental configuration of the valve timing regulation device 10 will be described with reference to FIG. 1 and FIG. 2.

The valve timing regulation device 10 includes a housing 13, a vane rotor 14, and an oil passage switching valve 15.

The housing 13 has a sprocket 16 and a case 17. The sprocket 16 fits to an end of the camshaft 12. The camshaft 12 rotatably supports the sprocket 16. A chain 18 is pulled over the sprocket 16 and the crankshaft 11. The sprocket 16 rotates in association with the crankshaft 11. The case 17 is of a cylindrical shape with a closed bottom and fixed to the sprocket 16 with a bolt 19 while an opening end is combined with the sprocket 16. The case 17 is provided with multiple partition walls 20 each protruding radially inward. The case 17 is also provided with an opening 21 opening to an outside space of the case 17 at a center of the bottom. The opening 21 is included in a drain space 22 on an opposite side to the camshaft 12 with the vane rotor 14 in between.

The vane rotor 14 has a boss 23, multiple vanes 24, and a plate washer 25. The boss 23 is of a cylindrical shape and fixed to an end of the camshaft 12 with a sleeve bolt 26. The vanes 24 protrude radially outward from the boss 23. A space defined between every pair of adjacent partition walls 20 in the case 17 is divided to a retard chamber 27 and an advance chamber 28 by one vane 24. The retard chamber 27 corresponds to a first hydraulic chamber and is located on one side of the vane 24 in a circumferential direction. The advance chamber 28 corresponds to a second hydraulic chamber and is located on the other side of the vane 24 in the circumferential direction. The plate washer 25 has a member different from the boss 23 and the vanes 24. The plate washer 25 together with the boss 23 is fastened to the camshaft 12 with the sleeve bolt 26. The vane rotor 14 rotates relative to the housing 13 in a retard direction or an advance direction according to hydraulic pressures in the retard chamber 27 and the advance chamber 28.

The oil passage switching valve 15 is provided to a center part of the vane rotor 14 and has the sleeve bolt 26 and a spool 29.

The sleeve bolt 26, which is a semi-screw bolt, is inserted into the vane rotor 14 from the drain space 22 and screwed into the camshaft 12. The sleeve bolt 26 is provided with a sleeve 32 between a head 30 and a screw portion 31. The sleeve 32 is formed in a cylindrical shape to extend axially at the center part of the vane rotor 14. The sleeve 32 penetrates through the boss 23 and is inserted into a hole 33 having a closed bottom and opening to an end face of the camshaft 12. The sleeve 32 has various radially penetrating ports.

The spool 29 moves axially within a spool storing hole 34 which is provided to the sleeve 32 and formed in a cylindrical shape with a closed bottom. A stopper plate 35 is fit and attached to an opening-end side of the spool storing hole 34. The spool 29 is urged toward the stopper plate 35 by a spring 36. An axial position of the spool 29 is determined by a balance between an urging force of the spring 36 and a pressing force of a linear solenoid 37 provided on an opposite side to the spool 29 with the stopper plate 35 in between. The spool 29 selectively connects the respective ports provided to the sleeve 32 according to an own axial position.

The oil passage switching valve 15 operates in three states as follows. One state is a first operation state in which the oil passage switching valve 15 connects the advance chamber 28 to the drain space 22 while connecting an oil pump 47 to the retard chamber 27. Another state is a second operation state in which the oil passage switching valve 15 connects the retard chamber 27 to the drain space 22 while connecting the oil pump 47 to the advance chamber 28. A rest state is a holding state in which the oil passage switching valve 15 closes both of the retard chamber 27 and the advance chamber 28. In the first operation state, a hydraulic oil is discharged from the advance chamber 28 while the hydraulic oil is supplied to the retard chamber 27. In the second state, the hydraulic oil is discharged from the retard chamber 27 while the hydraulic oil is supplied to the advance chamber 28. In the holding state, the hydraulic oil is held in both of the retard chamber 27 and the advance chamber 28.

The valve timing regulation device 10 configured in the manner as above makes the oil passage switching valve 15 operate in the first operation state when a rotational phase of the camshaft 12 is advanced from a target value. The vane rotor 14 thus rotates relative to the housing 13 in a retard direction and the rotational phase of the camshaft 12 is retarded.

The valve timing regulation device 10 makes the oil passage switching valve 15 operate in the second operation state when a rotational phase of the camshaft 12 is retarded from the target value. The vane rotor 14 thus rotates relative to the housing 13 in an advance direction and the rotational phase of the camshaft 12 is advanced.

The valve timing regulation device 10 makes the oil passage switching valve 15 operate in the holding state when a rotational phase of the camshaft 12 coincides with the target value. The rotational phase of the camshaft 12 is thus held.

The following will describe detailed configurations of the oil passage switching valve 15 and peripheral oil passages in the valve timing regulation device 10 with reference to FIG. 1 through FIG. 5.

Figure 3:
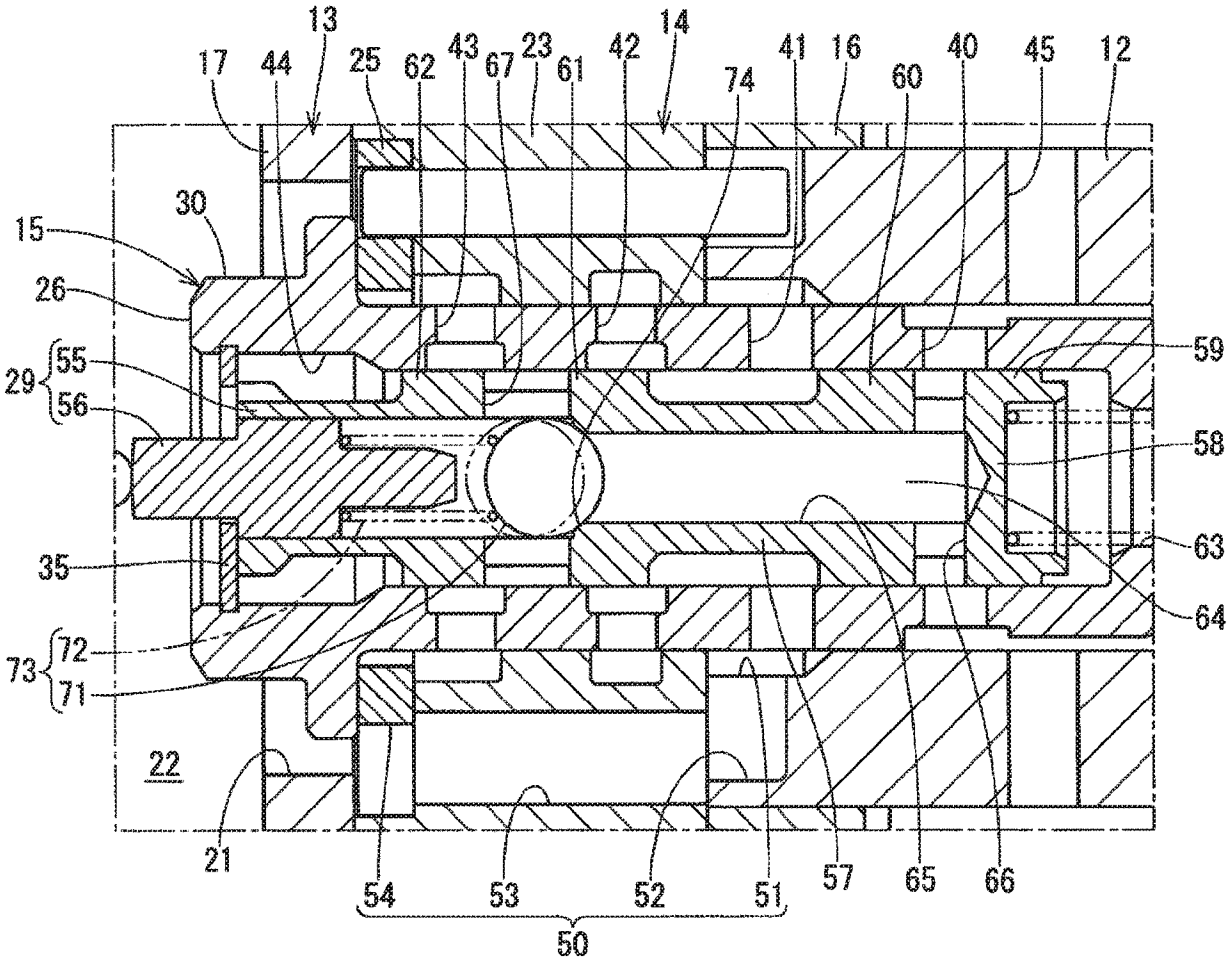
FIG. 3 is an enlarged view of a portion III of FIG. 1 to indicate an initial position of a spool in an oil passage switching valve.

As is shown in FIG. 1 and FIG. 3, the sleeve 32 has a supply port 40, a drain port 41, a first control port 42, a second control port 43, and a first drain oil passage 44, which are provided sequentially from the camshaft 12. The supply port 40 communicates with a discharge port of the oil pump 47 through supply oil passages 45 and 46. The drain port 41 communicates with the drain space 22 through a second drain oil passage 50. The first control port 42 communicates with the retard chamber 27 through a retard oil passage 48 of the vane rotor 14. The second control port 43 communicates with the advance chamber 28 through an advance oil passage 49 of the vane rotor 14. The first drain oil passage 44 has a circular clearance between the sleeve bolt 26 and the spool 29 and communicates with the drain space 22.

The camshaft 12 has the supply oil passage 45 radially penetrating through the camshaft 12, a circular groove 51 provided to an opening end of the hole 33 with the closed bottom, and a notch 52 extending radially outward from the circular groove 51. The supply oil passage 45 is provided at a position axially spaced from the sprocket 16 and connected to the oil pump 47 via the supply oil passage 46 provided to, for example, a cylinder head. The circular groove 51 and the notch 52 are on a side of the vane rotor 14 of the supply oil passage 45 and provided at a same axial position as the sprocket 16. Both of the circular groove 51 and the notch 52 open to the side of the vane rotor 14.

The boss 23 has a through-hole 53 that penetrates in an axial direction. A circumferential position of the through-hole 53 is same as the circumferential position of the notch 52. The through-hole 53 radially overlaps the notch 52 at least in part. Hence, the through-hole 53 communicates with the notch 52 at a first end.

The plate washer 25 has a notch 54 extending radially inward. A circumferential position of the notch 54 is same as the circumferential position of the through-hole 53. The notch 54 radially overlaps the through-hole 53 at least in part. Hence, the through-hole 53 communicates with the notch 54 at a second end.

The second drain oil passage 50 has a first half portion including the circular groove 51 and the notch 52 provided to the camshaft 12, and a second half portion including the through-hole 53 and the notch 54 provided to the vane rotor 14. In the present embodiment, the second drain oil passage 50 is provided to span the camshaft 12 and the vane rotor 14.

The spool 29 has a cylindrical member 55 with a closed bottom (hereinafter, referred to as the bottomed-cylindrical member 55) and a stopper member 56.

The bottomed-cylindrical member 55 is provided with a cylinder portion 57 provided coaxially with the sleeve 32, and a bottom 58 located on the side of the camshaft 12. The bottomed-cylindrical member 55 is axially movable from a position at which the cylinder portion 57 makes contact with the stopper plate 35 as is shown in FIG. 3 to a position at which the bottom 58 makes contact with the bottom of the spool storing hole 34 as is shown in FIG. 5 through an intermediate position shown in FIG. 4.

Also, the bottomed-cylindrical member 55 is provided with a first partition portion 59, a second partition portion 60, a third partition portion 61, and a fourth partition portion 62, which are sequentially provided from the bottom 58. Each partition portion is an annular protrusion protruding radially outward from the cylinder portion 57 or the bottom 58. The screw portion 31 of the sleeve bolt 26 has a through-hole 63 that extends in an axial direction. The first partition portion 59 divides a space between the through-hole 63 and the supply port 40 in a space defined by the bottom of the spool storing hole 34 and the bottomed-cylindrical member 55. The second partition portion 60 divides a space between the supply port 40 and the drain port 41 in a space defined by the sleeve 32 and the bottomed-cylindrical member 55. The third partition portion 61 divides a space between the drain port 41 and the first control port 42 or a space between the first control port 42 and the second control port 43 in the space defined by the sleeve 32 and the bottomed-cylindrical member 55. The fourth partition portion 62 divides a space between the first control port 42 and the second control port 43 or a space between the second control port 43 and the first drain oil passage 44 in the space defined by the sleeve 32 and the bottomed-cylindrical member 55.

The bottomed-cylindrical member 55 also has a connection oil passage 64 provided to a shaft center part to connect the supply port 40 to either the first control port 42 or the second control port 43 according to an own axial position. The connection oil passage 64 has an axial hole 65, an inlet hole 66 radially and outwardly penetrating through the bottomed-cylindrical member 55 from the axial hole 65 between the first partition portion 59 and the second partition portion 60, and an outlet hole 67 radially and outwardly penetrating through the bottomed-cylindrical member 55 from the axial hole 65 between the third partition portion 61 and the fourth partition portion 62. The inlet hole 66 communicates with the supply port 40 independently of the axial position of the spool 29. The outlet hole 67 communicates with the second control port 43 when the spool 29 is at an axial position shown in FIG. 3, communicates with the first control port 42 when the spool 29 is at an axial position shown in FIG. 5, and communicates with neither the first control port 42 nor the second control port 43 when the spool 29 is at an axial position shown in FIG. 4.

As is shown in FIG. 3, the stopper member 56 is press-fit in an opening end of the cylinder portion 57 of the bottomed-cylindrical member 55. The stopper member 56 and the bottomed-cylindrical member 55 are formed integrally and move together when pressed by the linear solenoid 37.

A check valve 73 having a valve body 71 and a spring 72 is provided in the axial hole 65 of the connection oil passage 64. The valve body 71 is of a spherical shape and allowed to be seated in or move away from a valve seat 74 provided in an inner wall of the axial hole 65. The spring 72 urges the valve body 71 toward the valve seat 74. The check valve 73 blocks a flow of the hydraulic oil flowing the connection oil passage 64 from the outlet hole 67 to the inlet hole 66 when the valve body 71 is seated in the valve seat 74 as are indicated by solid lines in FIG. 3 through FIG. 5. Meanwhile, the check valve 73 allows the hydraulic oil to flow from the inlet hole 66 to the outlet hole 67 when the valve body 71 moves away from the valve seat 74 as are indicated by alternate long and double-dashed lines in FIG. 3 through FIG. 5.

FIG. 3 shows the spool 29 at an initial position which is an axial position corresponding to the second operation state when the spool 29 is in contact with the stopper plate 35. When the axial position of the spool 29 is the initial position, the supply port 40 is allowed to communicate with the second control port 43 through the connection oil passage 64 while the first control port 42 communicates with the drain port 41. When the hydraulic oil is supplied to the connection oil passage 64 from the supply port 40 in such a circumstance, the check valve 73 opens due to a flowing pressure of the hydraulic oil, which allows the supply port 40 to communicate with the second control port 43. The hydraulic oil flowing the supply oil passage 45 is thus supplied to the advance chamber 28 through the supply port 40, the connection oil passage 64, the second control port 43, and the advance oil passage 49. Meanwhile, the hydraulic oil in the retard chamber 27 is discharged to the drain space 22 through the retard oil passage 48, the first control port 42, the drain port 41, and the second drain oil passage 50.

Figure 4:
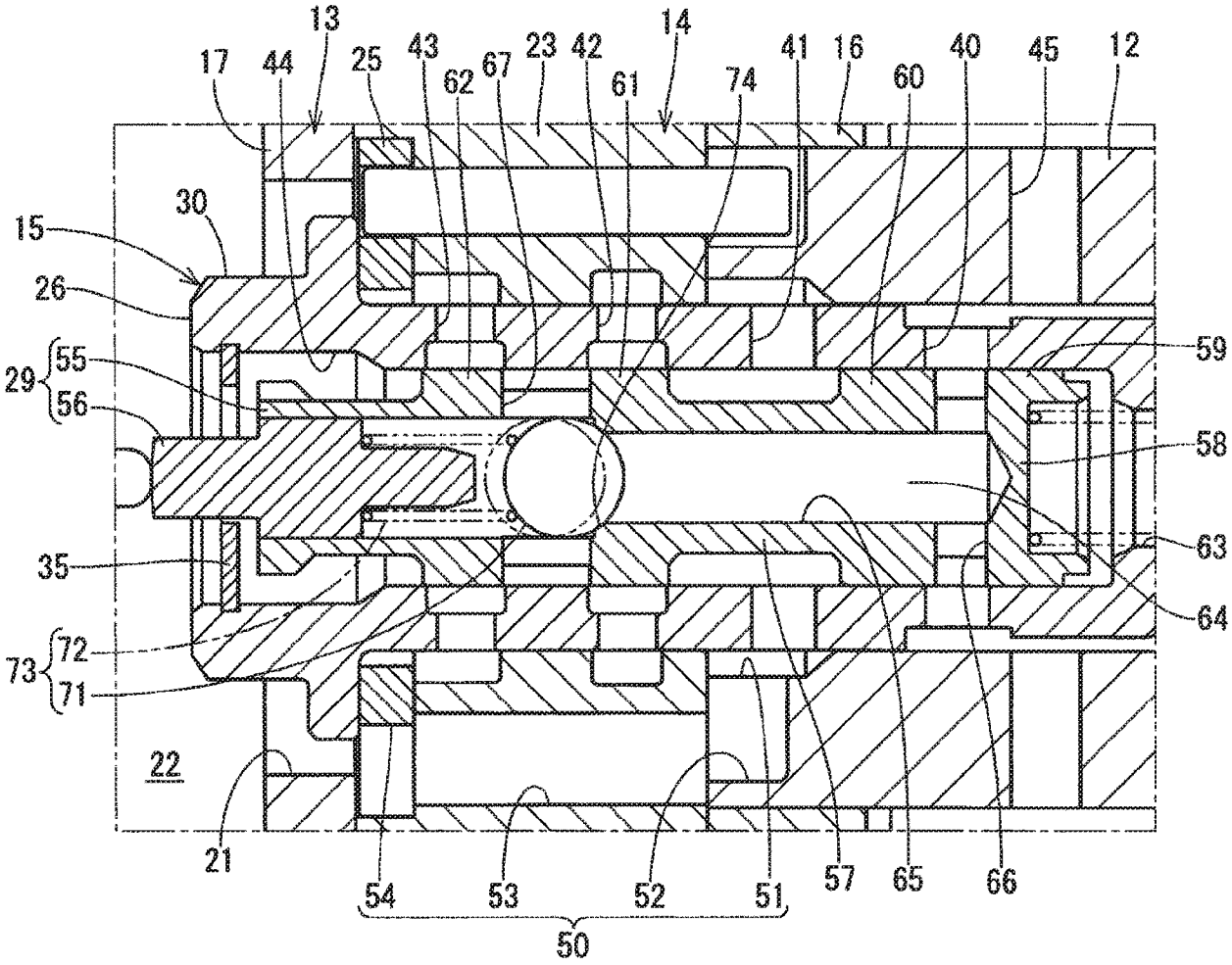
FIG. 4 is a view showing a state when the spool in a state of FIG. 3 moves by a predetermined distance.
Figure 5:
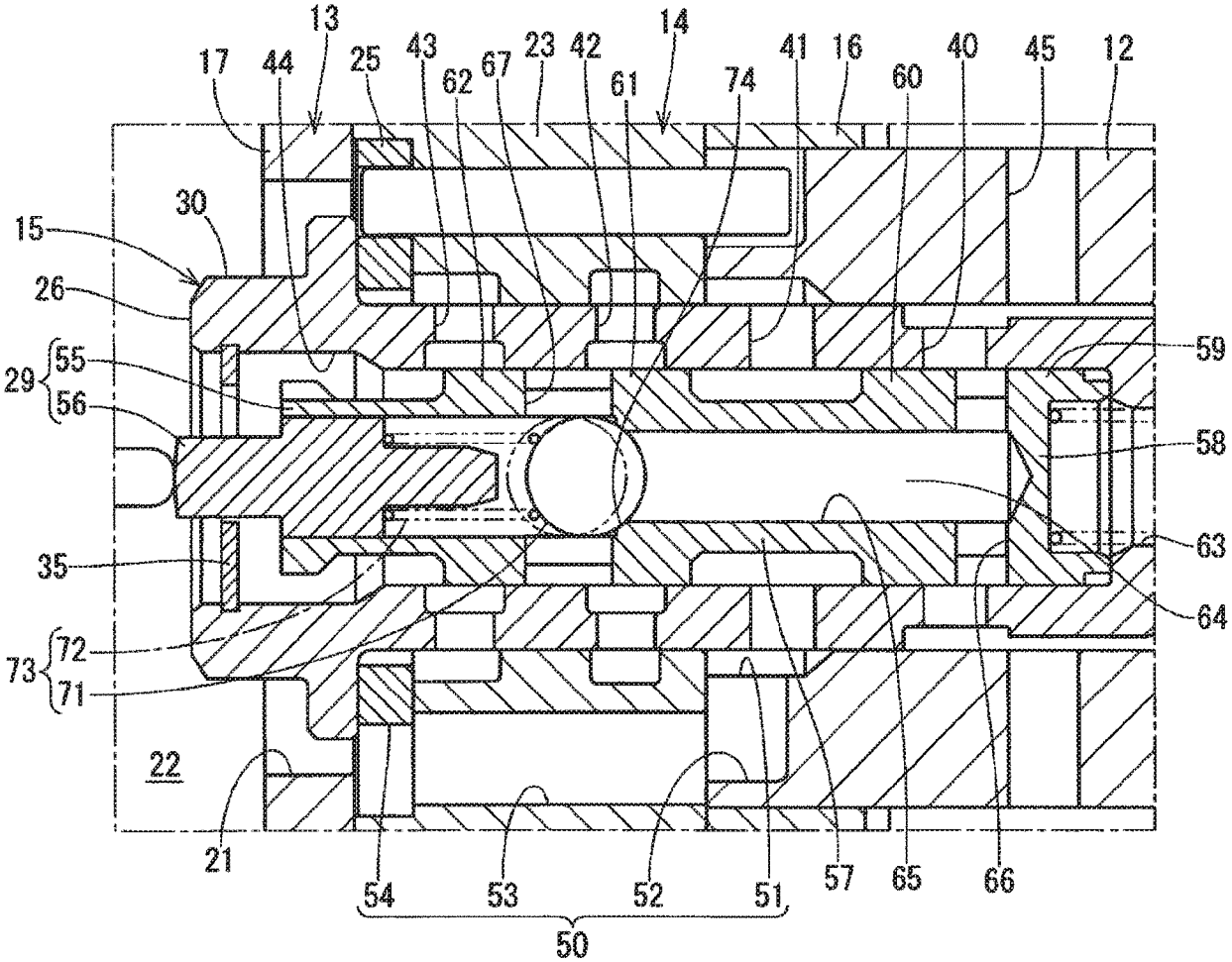
FIG. 5 is a view showing a state when the spool in a state of FIG. 4 moves by a predetermined distance.

When the spool 29 in the state shown in FIG. 3 moves by a predetermined distance from the initial position as is shown in FIG. 4, a communication between the supply port 40 and the second control port 43 and a communication between the drain port 41 and the first control port 42 are closed. The hydraulic oil is thus held in the retard chamber 27 and the advance chamber 28.

When the spool 29 in the state shown in FIG. 4 moves by a predetermined distance as is shown in FIG. 5, the supply port 40 is allowed to communicate with the first control port 42 through the connection oil passage 64 while the second control port 43 communicates with the first drain oil passage 44. When the hydraulic oil is supplied to the connection oil passage 64 from the supply port 40 in such a circumstance, the check valve 73 opens due to a flowing pressure of the hydraulic oil, which allows the supply port 40 to communicate with the first control port 42. Hence, the hydraulic oil flowing the supply oil passage 45 is supplied to the retard chamber 27 through the supply port 40, the connection oil passage 64, the first control port 42, and the retard oil passage 48. Meanwhile, the hydraulic oil in the advance chamber 28 is discharged to the drain space 22 through the second control port 43 and the first drain oil passage 44.

As has been described, the valve timing regulation device 10 of the first embodiment includes the housing 13, the vane rotor 14, the sleeve 32, and the spool 29. The sprocket 16 of the housing 13 is fit to the end of the camshaft 12 and is rotatably supported by the camshaft 12. The sleeve 32 has the supply port 40, the drain port 41, the first control port 42, the second control port 43, and the first drain oil passage 44, which are provided sequentially from the camshaft 12. The spool 29 has the connection oil passage 64 provided to the shaft center part to connect the supply port 40 to either the first control port 42 or the second control port 43 according to the own axial position. The drain port 41 is connected to the drain space 22 through the second drain oil passage 50 provided to span the vane rotor 14 and the camshaft 12.

In the valve timing regulation device 10 configured as above, the hydraulic oil in the advance chamber 28 is discharged to the drain space 22 through the second control port 43 and the first drain oil passage 44 located on the side of the drain space 22. Meanwhile, the hydraulic oil in the retard chamber 27 is discharged to the drain space 22 through the first control port 42, the drain port 41, and the second drain oil passage 50 located on the side of the camshaft 12. In short, the hydraulic oil in either hydraulic chamber is discharged to the drain space 22 on the opposite side to the camshaft 12 with the vane rotor 14 in between. Such a configuration eliminates a need to provide a discharge hole to the camshaft 12 between a bearing portion 75 supporting the camshaft 12 and the housing 13. Consequently, a shaft length of the camshaft 12 can be shorter by omitting the discharge hole.

Hence, according to the first embodiment, even when the connection oil passage 64 is provided to the shaft center part of the spool 29 in the oil passage switching valve 15, a shaft length of the camshaft 12 can be shorter.

A comparative embodiment will now be described. In the comparative embodiment, a sleeve of an oil passage switching valve has a supply port, a first drain port, a first control port, a second control port, and a second drain port, which are provided sequentially from a camshaft side. Hydraulic oil passing through the first drain port is discharged to an outside from a discharge hole that opens in an outer peripheral surface of the camshaft. The discharge hole is provided at a position axially spaced from a portion (camshaft fitting portion) of a housing where the camshaft is fit to. According to the comparative embodiment configured as above, in a case where a length of the camshaft fitting portion varies from device to device, oil passage switching valves have to be designed one by one to make axial positions of the first drain port of the sleeve and the discharge hole of the camshaft coincide with each other. Hence, it may become difficult to make an oil passage switching valve common among substantially all types of device.

By contrast, it is not necessary to provide the camshaft 12 with a discharge hole in the first embodiment. Hence, even when a length of the camshaft fitting portion varies from device to device, it is not necessary to change the axial position of the drain port. Consequently, the oil passage switching valve can be common among substantially all types of device.

In the first embodiment, the second drain oil passage 50 has the first half portion having the circular groove 51 and the notch 52 provided to the camshaft 12, and the second half portion having the through-hole 53 and the notch 54 provided to the vane rotor 14.

By forming the second drain oil passage 50 in the manner as above, it is necessary to provide the vane rotor 14 only with the through-hole 53 that penetrates in the axial direction and the notch 54. Consequently, a physical size of the valve timing regulation device 10 can be reduced in the axial direction.

(Second Embodiment)

Figure 6:
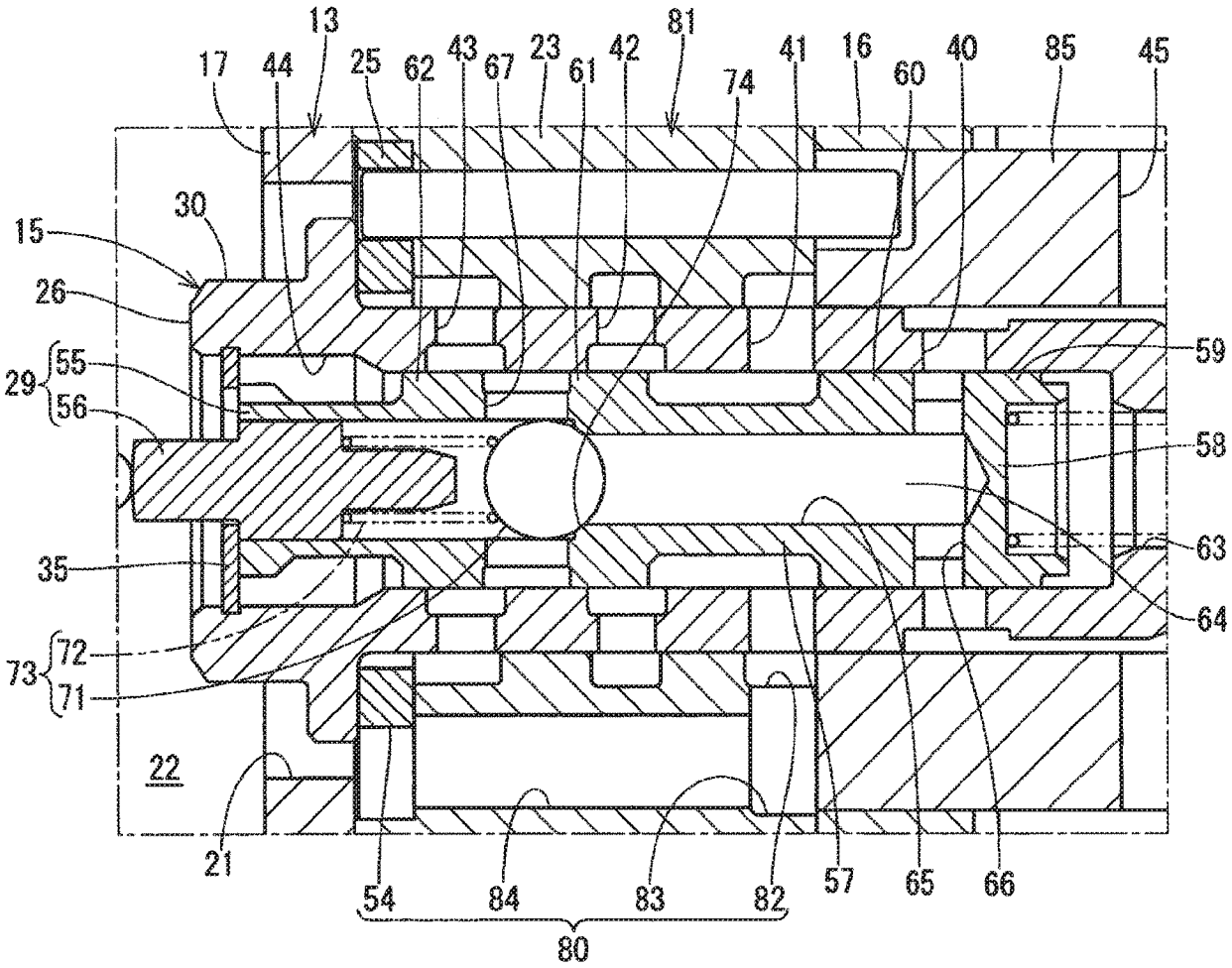
FIG. 6 is a sectional view of a valve timing regulation device according to a second embodiment of the present disclosure and corresponds to FIG. 3 of the first embodiment.

In a second embodiment of the present disclosure, as is shown in FIG. 6, a second drain oil passage 80 has a circular groove 82, a notch 83, a through-hole 84, and the notch 54, all of which are provided to a vane rotor 81.

Even when the second drain oil passage 80 is only provided to the vane rotor 81 as in the second embodiment, an effect same as the same effect of the first embodiment above can be obtained.

In the second embodiment, it is not necessary to provide the second drain oil passage 80 to a camshaft 85. Hence, manufacturing costs of the camshaft 85 can be saved.

(Other Embodiments)

In other embodiments of the present disclosure, a second drain oil passage may have a circular groove provided to a camshaft or a vane rotor, and a through-hole provided to the vane rotor. In short, no notch may be provided to let the circular groove and the through-hole communicate directly with each other.

In other embodiments of the present disclosure, a vane rotor may have multiple members. In such a case, a second drain oil passage may have holes or the like provided to the respective members.

In other embodiments of the present disclosure, a plate washer may be omitted.

In other embodiments of the present disclosure, a check valve may be omitted from a spool connection oil passage.

In other embodiments of the present disclosure, a first hydraulic chamber may be an advance chamber and a second hydraulic chamber may be a retard chamber.

In other embodiments of the present disclosure, a housing may have three or more members.

In other embodiments of the present disclosure, outer teeth over which a chain is pulled may be provided to anywhere in a housing. That is, a portion of the housing fit to a camshaft is not limited to a sprocket.

In other embodiments of the present disclosure, a housing may be linked to a crankshaft by a belt as an example of a transmission member other than the chain.

In other embodiments of the present disclosure, a vane rotor may be fixed to an end of a crankshaft and a housing may rotate in association with a camshaft.

In other embodiments of the present disclosure, an outlet port of a connection oil passage may communicate slightly with both of a first control port and a second control port in a holding state.

In other embodiments of the present disclosure, a valve timing regulation device may regulate valve timing of an exhaust valve of an internal combustion engine.

The present disclosure is not limited to the embodiment mentioned above, and can be applied to various embodiments which are also within the spirit and scope of the present disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A valve timing regulation device provided to a power transmission path transmitting a power from a drive shaft to a driven shaft of an internal combustion engine, the valve timing regulation device regulating valve timing of a valve driven to open and close by the driven shaft, the valve timing regulation device comprising:

a housing rotating in association with a first shaft which is one of the drive shaft and the driven shaft, the housing being fit to an end of a second shaft which is an other one of the drive shaft and the driven shaft, the housing being rotatably supported by the second shaft;

a vane rotor fixed to an end of the second shaft, the vane rotor having a vane dividing an internal space of the housing to a first hydraulic chamber on a first side in a circumferential direction and a second hydraulic chamber on a second side in the circumferential direction, the vane rotor rotating relative to the housing according to a pressure of a hydraulic oil supplied to the first hydraulic chamber and the second hydraulic chamber;

a sleeve provided to a center part of the vane rotor, the sleeve having a supply port communicating with a supply oil passage of the second shaft, a drain port communicating with a drain space on an opposite side to the second shaft with the vane rotor in between, a first control port communicating with the first hydraulic chamber, a second control port communicating with the second hydraulic chamber, and a first drain oil passage communicating with the drain space, which are provided sequentially from the second shaft; and a spool axially moving in the sleeve, the spool having a connection oil passage provided to a shaft center part to connect the supply port to either the first control port or the second control port according to an own axial position, the spool connecting the second control port to the first drain oil passage while connecting the supply port to the first control port when the hydraulic oil is supplied to the first hydraulic chamber, the spool connecting the first control port to the drain port while connecting the supply port to the second control port when the hydraulic oil is supplied to the second hydraulic chamber, wherein the drain port is connected to the drain space through a second drain oil passage provided to the vane rotor or to span the vane rotor and the second shaft.

2. The valve timing regulation device according to claim 1, wherein:

the second drain oil passage has a first half portion provided to the second shaft, and a second half portion provided to the vane rotor.

3. The valve timing regulation device according to claim 1, wherein:

the second drain oil passage is only provided to the vane rotor.

* * * * *